US010483659B1

(12) United States Patent
Lyders et al.

(10) Patent No.: US 10,483,659 B1
(45) Date of Patent: Nov. 19, 2019

(54) GROUNDING CLIP FOR BONDED VANES

(71) Applicant: United Technologies Corporation, Farmington, CT (US)

(72) Inventors: David R. Lyders, Glastonbury, CT (US); Nicholas D. Stilin, Higganum, CT (US); Kevin M. Bell, Higganum, CT (US)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 16/194,931

(22) Filed: Nov. 19, 2018

(51) Int. Cl.

| | |
|---|---|
| ***H01R 4/66*** | (2006.01) |
| ***H01R 4/64*** | (2006.01) |
| ***H01R 43/027*** | (2006.01) |
| ***F01D 9/04*** | (2006.01) |
| ***F01D 25/28*** | (2006.01) |

(52) U.S. Cl.
CPC ..... *H01R 4/64* (2013.01); *F01D 9/042* (2013.01); *F01D 25/28* (2013.01); *H01R 43/027* (2013.01); *F05D 2220/32* (2013.01); *F05D 2230/60* (2013.01); *F05D 2240/12* (2013.01); *F05D 2240/91* (2013.01); *F05D 2300/48* (2013.01)

(58) Field of Classification Search
CPC ..... H01R 4/64; H01R 43/027; F01D 9/042; F01D 25/28; F05D 2220/32; F05D 2230/60; F05D 2240/12
USPC ..... 439/92
See application file for complete search history.

(56) References Cited

U.S. PATENT DOCUMENTS

| | | | | |
|---|---|---|---|---|
| 2,444,293 | A * | 6/1948 | Holt | B64C 21/08 244/129.1 |
| 2,627,011 | A * | 1/1953 | Eaves | B60S 1/3805 15/250.07 |
| 3,556,695 | A * | 1/1971 | Yamamoto | F01C 19/10 418/61.2 |
| 4,180,371 | A * | 12/1979 | Ivanko | F01D 5/18 415/115 |
| 5,026,016 | A * | 6/1991 | Lisowski | F16B 21/09 248/225.11 |
| 5,269,651 | A * | 12/1993 | Ostermeir | F01D 9/041 415/134 |
| 5,533,631 | A * | 7/1996 | Marchetti | H05K 7/1418 211/41.17 |
| 6,267,606 | B1 * | 7/2001 | Poplawski | C07D 491/22 361/752 |
| 7,014,421 | B2 * | 3/2006 | French | F01D 17/143 415/197 |

(Continued)

*Primary Examiner* — Abdullah A Riyami
*Assistant Examiner* — Vladimir Imas
(74) *Attorney, Agent, or Firm* — Bachman & LaPointe, P.C.

(57) ABSTRACT

A grounding clip for an organic matrix composite guide vane with a metallic sheath comprises the organic matrix composite guide vane includes a body having a leading edge and a trailing edge opposite the leading edge and a root end extending between the leading end edge and the trailing edge. The metallic sheath is attached proximate the leading edge and extends to the root end. A metallic attachment fitting has a receiver configured to receive the root end of the organic matrix composite guide vane for coupling the organic matrix composite guide vane to the metallic attachment fitting. The grounding clip is coupled to the sheath proximate the root end; wherein the grounding clip is electrically connected to the metallic attachment fitting and the metallic sheath.

20 Claims, 1 Drawing Sheet

(56) References Cited

U.S. PATENT DOCUMENTS 8,006,934 B2 * 8/2011 Alexander ..... F02C 7/047 219/526
8,221,139 B2 * 7/2012 Qin ..... H01R 31/08 439/92
8,226,359 B1 * 7/2012 Jansen ..... F01D 17/16 415/160
8,590,223 B2 * 11/2013 Kilgore ..... H01R 4/26 52/173.3
8,690,531 B2 * 4/2014 Tudor ..... F01D 5/141 415/209.4
8,851,855 B2 10/2014 James et al.
9,284,887 B2 * 3/2016 McKenney ..... F01D 25/164
9,376,924 B2 6/2016 Murdock et al.
9,617,864 B2 * 4/2017 Firnhaber ..... F01D 9/041
10,024,186 B2 * 7/2018 Hennequin ..... B23P 15/04
10,066,495 B2 * 9/2018 Roberts ..... F01D 5/147
10,099,306 B2 * 10/2018 Cook, III ..... B23K 1/0018
10,151,219 B2 * 12/2018 McKenney ..... F01D 25/164
10,233,938 B2 * 3/2019 Strock ..... F04D 29/164
10,294,817 B2 * 5/2019 Lyders ..... F01D 25/02
2010/0014982 A1 * 1/2010 Haje ..... F01D 5/282 416/241 R
2012/0171025 A1 * 7/2012 Tudor ..... F01D 5/141 415/191
2013/0052004 A1 * 2/2013 Stilin ..... F01D 9/042 415/211.2
2013/0333350 A1 * 12/2013 Stilin ..... F01D 9/02 60/226.1
2015/0167490 A1 * 6/2015 Hennequin ..... B23P 15/04 415/160
2015/0218957 A1 * 8/2015 Klinetob ..... F01D 9/02 60/726
2016/0108747 A1 4/2016 Obuchi et al.
2016/0245113 A1 * 8/2016 Lyders ..... H05B 3/0014
2016/0376899 A1 * 12/2016 Prugarewicz ..... F01D 5/147 415/115
2017/0002661 A1 * 1/2017 Opderbecke ..... F01D 5/147
2017/0022829 A1 * 1/2017 Freeman ..... F01D 9/041

* cited by examiner

GROUNDING CLIP FOR BONDED VANES

BACKGROUND

The present disclosure is directed to a grounding clip for a hybrid composite/metallic guide vane of a gas turbine engine.

Certain gas turbine engines include guide vanes made from organic matrix composite materials. These guide vanes can include a metallic sheath located at the leading edge of the guide vane. The metallic sheath functions to protect the composite materials of the guide vane. The composite guide vane and the metallic sheath can be attached to a guide vane attachment fitting to secure the vanes. The attachment fittings are located on either end of the guide vane. The attachment fittings are metallic.

Current designs utilize a metallic through-bolt that extends between the guide vane and the metallic attachment fitting to secure the guide vane. An adhesive is also utilized to secure the guide vane to the attachment fitting.

A grounding path is required to enable static electricity generated by airflow over the guide vane to discharge to the engine, or to allow for a grounding path in the event of lightning strike on an engine.

In order to properly function to conduct the electricity, the through-bolt relies on intimate electrical contact between the metallic attachment fitting and the through-bolt. The path of conduction can include flowing through the through-bolt to either the composite fibers themselves or to an embedded grounding strap within the composite vane, to make the electrical connection which provides the ground path. Other options for grounding the guide vane and metallic sheath can include coupling a jumper cable to the metallic sheath at the leading edge of the composite vane to the metallic fitting. The jumper cable can adversely affect aerodynamics, since it is exterior to the attachment fitting and exposed to the working fluid of the guide vane.

The presence of the adhesive between the guide vane and the metallic attachment fitting, as well as the gapping required to ensure the two pieces fit together, create difficult challenged for a design to have intimate contact along the sides of the guide vane and the attachment fitting. This inherent structure creates a problem for obtaining a robust electrical grounding path for the composite matrix guide vanes with the metallic sheath and metallic attachment fitting.

What is needed is a robust attachment scheme that includes an intimate electrical contact bridging the gaps between the guide vane, metallic sheath and metallic attachment fitting.

SUMMARY

In accordance with the present disclosure, there is provided a grounding clip for an organic matrix composite guide vane with a metallic sheath comprising the organic matrix composite guide vane comprising a body having a leading edge and a trailing edge opposite the leading edge and a root end extending between the leading end edge and the trailing edge; the metallic sheath attached proximate the leading edge and extending to the root end; a metallic attachment fitting having a receiver configured to receive the root end of the organic matrix composite guide vane for coupling the organic matrix composite guide vane to the metallic attachment fitting; and the grounding clip coupled to the sheath proximate the root end; wherein the grounding clip is electrically connected to the metallic attachment fitting and the metallic sheath.

In another and alternative embodiment, the grounding clip further comprises an adhesive coupled to the organic matrix composite guide vane proximate the root end and coupled to the metallic attachment fitting, wherein the adhesive is configured to secure the organic matrix composite guide vane to the metallic attachment fitting.

In another and alternative embodiment, the metallic sheath comprises an indent configured to engage the grounding clip.

In another and alternative embodiment, the indent is located proximate the root end.

In another and alternative embodiment, the grounding clip is secured within the receiver.

In another and alternative embodiment, the grounding clip is interference fit into the receiver and the metallic sheath.

In another and alternative embodiment, the metallic sheath extends partially into the receiver.

In another and alternative embodiment, the grounding clip is a flexible material.

In another and alternative embodiment, the grounding clip comprises a wire.

In another and alternative embodiment, the grounding clip comprises a flattened metallic ribbon.

In another and alternative embodiment, the grounding clip comprises a perforated ribbon.

In another and alternative embodiment, the grounding clip comprises an electrically conductive material.

In another and alternative embodiment, the adhesive penetrates at least a portion of the grounding clip.

In accordance with the present disclosure, there is provided a process for electrically coupling an organic matrix composite guide vane metallic sheath to a metallic attachment fitting comprising attaching a grounding clip to a metallic sheath coupled over a portion of an organic matrix composite guide vane; coupling the organic matrix composite guide vane to a metallic attachment fitting; and electrically coupling the metallic sheath and the metallic attachment fitting through the grounding clip.

In another and alternative embodiment, the process further comprises coupling the metallic sheath to the organic matrix composite guide vane along a leading edge of the composite guide vane.

In another and alternative embodiment, the process further comprises coupling the grounding clip to the metallic sheath adjacent a root end of the organic matrix composite guide vane.

In another and alternative embodiment, the process further comprises coupling an adhesive to the organic matrix composite guide vane proximate a root end and coupling the adhesive to the metallic attachment fitting, wherein the adhesive is configured to secure the organic matrix composite guide vane to the metallic attachment fitting.

In another and alternative embodiment, the adhesive flows through a portion of the grounding clip to adhere to the metallic attachment fitting and the metallic sheath.

In another and alternative embodiment, the grounding clip is secured within the receiver in the absence of an aerodynamic effect external to the receiver.

In another and alternative embodiment, the process further comprises engaging the grounding clip within an indent formed in the metallic sheath.

Other details of the grounding clip are set forth in the following detailed description and the accompanying drawings wherein like reference numerals depict like elements.

DETAILED DESCRIPTION

Figure 2:
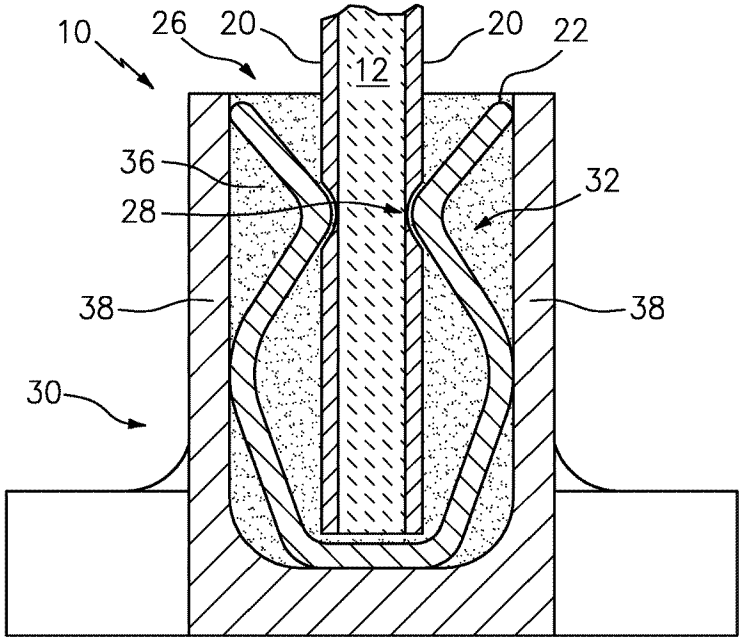
FIG. 2 is a cross section of a schematic representation of an exemplary grounding clip attached to an organic matrix composite guide vane with metallic sheath inserted into a metallic attachment fitting.
Figure 1:
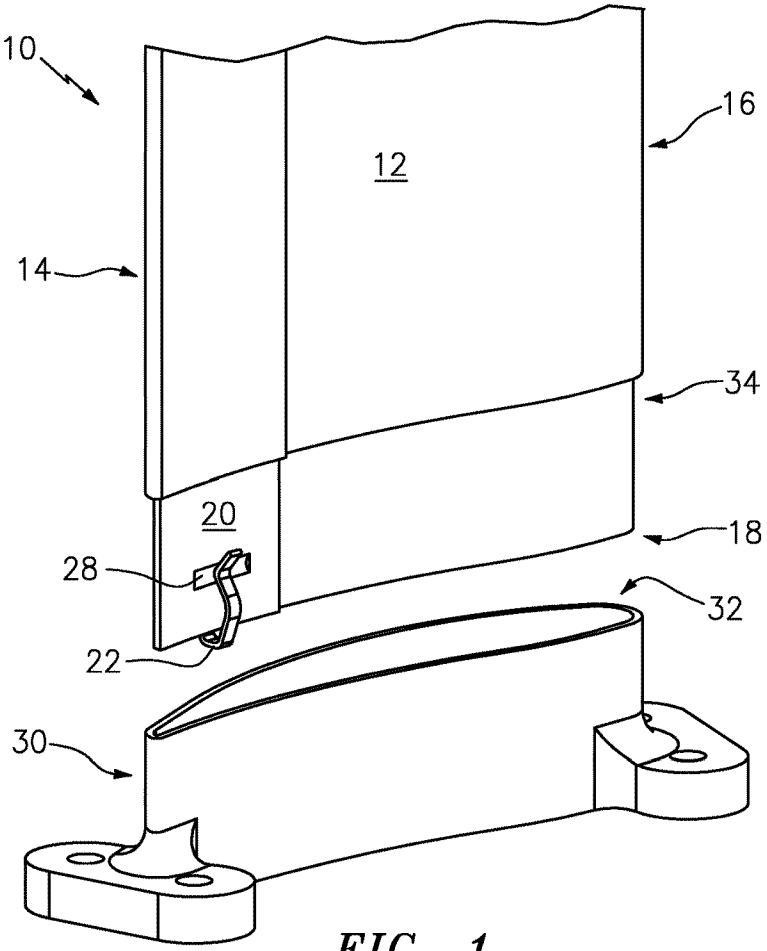
FIG. 1 is an exploded view of a schematic representation of an exemplary grounding clip attached to an organic matrix composite guide vane with metallic sheath.

Referring now to FIG. 1, there is illustrated an organic matrix composite guide vane 10, such as a compressor vane. The organic matrix composite guide vane 10 has a body portion 12 with a leading edge 14 and a trailing edge 16 opposite the leading edge 14. A root end 18 is located between the leading edge 14 and the trailing edge 16. Surrounding a portion of the organic matrix composite guide vane 10 proximate the leading edge is a metallic sheath 20. In an alternative embodiment, metallic sheath 20 can be located over different portions of the body 12, in addition to the leading edge 14, such as over the trailing edge 16.

A grounding clip or simply clip 22 can be coupled to the metallic sheath 20. The grounding clip 22 can be attached over the exterior 24 of the metallic sheath 20. The grounding clip 22 makes electrical contact with the metallic sheath 20, so that electricity can flow from the metallic sheath 20 through the grounding clip 22. The grounding clip 22 can include an open end 26 configured to receive the organic matrix composite guide vane 10 and metallic sheath 20. The grounding clip 22 can be a flexible material that biases against the metallic sheath 20. The grounding clip 22 can comprise a wire, a flattened metallic ribbon or a perforated ribbon material. The grounding clip 22 comprises an electrically conductive material.

An indent 28 can be formed in the metallic sheath 20. The indent 28 can be configured to receive a portion of the grounding clip 22. The indent 28 can be configured to secure the grounding clip 22 to the metallic sheath and organic matrix composite guide vane 10. The indent 28 can also function to secure the grounding clip 22 and maintain the electrical continuity between the grounding clip 22 and the metallic sheath 20. The indent 28 can be located proximate the root end 18.

A metallic attachment fitting 30 is configured to be coupled to the organic matrix composite guide vane 10. There can be a metallic attachment fitting 30 secured to the root end 18 and another metallic attachment fitting (not shown) attached to the opposite end (not shown). The metallic attachment fitting 30 includes a receiver 32. The receiver 32 is configured as a slot or pocket that encloses the root end 18 of the organic matrix composite guide vane 10. The receiver 32 has an arcuate shape the matches the guide vane 10. In an exemplary embodiment, the organic matrix composite guide vane 10 can include an undercut or cutback portion 34 proximate the root end 18 to fit within the receiver 32.

An adhesive 36 can be utilized to secure the organic matrix composite guide vane 10 to the metallic attachment fitting 30. The adhesive 36 bonds the root end 18 of the organic matrix composite guide vane 10 inside the receiver 32 of the metallic attachment fitting 30.

In an exemplary embodiment, the grounding clip 22 can be configured so that the adhesive 36 penetrates at least a portion of the grounding clip 22. The adhesive 36 can flow through and around the grounding clip 22, so that the grounding clip 22 does not prevent the adhesive from forming a secure bond between the organic matrix composite guide vane 10 and the metallic attachment fitting 30.

In an exemplary embodiment, the grounding clip 22 can be attached to the metallic sheath 20 and remain within the receiver 32, such that the grounding clip 22 does not interfere with the aerodynamics of the fluid flowing past the organic matrix composite guide vane 10. The grounding clip 22 is contained within the confines of the receiver 32. The grounding clip 22 is secured within the receiver 32 in the absence of an aerodynamic effect external to said receiver 32. The guide vane 10, with the grounding clip 22 in place, is inserted into the metallic attachment fitting 30, such that the grounding clip 22 can deform and bridge between receiver sides 38 of the attachment fitting 30 to the indent 28 in the sheath 20. The grounding clip 22 is interference fit into the receiver 32 and the metallic sheath 20. After the guide vane 10 is bonded into the metallic attachment fitting 30, the grounding clip 22 can make the electrical connection between the guide vane leading edge 14 and the attachment fitting 30, providing the grounding path required by the engine.

An advantage of the grounding clip 22 is that the grounding clip 22 can be designed to be thin and flexible. If a bond quality is required of the adhesive 36, a perforated grounding clip 22 can allow the adhesive 36 to fully encapsulate the grounding clip 22. Thus the grounding clip 22 can allow for the adhesive 36 to flow instead of acting as a barrier.

The grounding clip can snap into place on the leading edge, and can be fully encapsulated within the receiver so as not to produce any external aerodynamic disruption that an external welded jumper could cause.

The exemplary guide vane includes a simplified design that eliminates the need to use a separate grounding cable embedded in the part.

The exemplary disclosed assembly design is simplified because grounding bolts on the inner diameter end of the vane and on the outer diameter end of the vane are no longer required, thus eliminating hardware, weight and cost.

There has been provided a grounding clip for an organic matrix composite guide vane with metallic sheath. While the grounding clip has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A grounding clip for an organic matrix composite guide vane with a metallic sheath comprising:

the organic matrix composite guide vane comprising a body having a leading edge and a trailing edge opposite the leading edge and a root end extending between said leading end edge and said trailing edge;

the metallic sheath attached proximate said leading edge and extending to said root end;

a metallic attachment fitting having a receiver configured to receive said root end of said organic matrix composite guide vane for coupling said organic matrix composite guide vane to said metallic attachment fitting; and the grounding clip coupled to said sheath proximate said root end; wherein said grounding clip is electrically connected to said metallic attachment fitting and said metallic sheath.

2. The grounding clip according to claim 1, further comprising:

an adhesive coupled to said organic matrix composite guide vane proximate said root end and coupled to said metallic attachment fitting, wherein said adhesive is configured to secure said organic matrix composite guide vane to said metallic attachment fitting.

3. The grounding clip according to claim 1, wherein said metallic sheath comprises an indent configured to engage said grounding clip.

4. The grounding clip according to claim 3, wherein said indent is located proximate said root end.

5. The grounding clip according to claim 1, wherein said grounding clip is secured within said receiver.

6. The grounding clip according to claim 1, wherein said grounding clip is interference fit into said receiver and said metallic sheath.

7. The grounding clip according to claim 1, wherein said metallic sheath extends partially into said receiver.

8. The grounding clip according to claim 1, wherein said grounding clip is a flexible material.

9. The grounding clip according to claim 1, wherein said grounding clip comprises a wire.

10. The grounding clip according to claim 1, wherein said grounding clip comprises a flattened metallic ribbon.

11. The grounding clip according to claim 1, wherein said grounding clip comprises a perforated ribbon.

12. The grounding clip according to claim 1, wherein said grounding clip comprises an electrically conductive material.

13. The grounding clip according to claim 2, wherein said adhesive penetrates at least a portion of said grounding clip.

14. A process for electrically coupling an organic matrix composite guide vane metallic sheath to a metallic attachment fitting comprising:

attaching a grounding clip to a metallic sheath coupled over a portion of an organic matrix composite guide vane;

coupling said organic matrix composite guide vane to a metallic attachment fitting; and electrically coupling said metallic sheath and said metallic attachment fitting through said grounding clip.

15. The process of claim 14, further comprising:

coupling said metallic sheath to said organic matrix composite guide vane along a leading edge of said composite guide vane.

16. The process of claim 14, further comprising:

coupling said grounding clip to said metallic sheath adjacent a root end of said organic matrix composite guide vane.

17. The process of claim 14, further comprising:

coupling an adhesive to said organic matrix composite guide vane proximate a root end and coupling said adhesive to said metallic attachment fitting, wherein said adhesive is configured to secure said organic matrix composite guide vane to said metallic attachment fitting.

18. The process of claim 17, wherein said adhesive flows through a portion of said grounding clip to adhere to said metallic attachment fitting and said metallic sheath.

19. The process of claim 14, wherein said grounding clip is secured within said receiver in the absence of an aerodynamic effect external to said receiver.

20. The process of claim 14, further comprising:

engaging said grounding clip within an indent formed in said metallic sheath.

* * * * *